US006192605B1

(12) United States Patent
Challant

(10) Patent No.: US 6,192,605 B1
(45) Date of Patent: Feb. 27, 2001

(54) WELTED SHOE CONSTRUCTION AND METHOD

(75) Inventor: Mark H. Challant, Wayland, MA (US)

(73) Assignee: E.S. Originals, Inc., New York, NY (US)

( * ) Notice: Subject to any disclaimer, the term of this patent is extended or adjusted under 35 U.S.C. 154(b) by 0 days.

(21) Appl. No.: 09/352,267

(22) Filed: Jul. 13, 1999

(51) Int. Cl.[7] ..... A43B 13/18; A43D 11/00

(52) U.S. Cl. ..... 36/17 R; 36/17 PW; 36/21; 36/12; 12/142 D; 12/142 T

(58) Field of Search ..... 36/17 R, 17 PW, 36/21, 22 R, 12, 14, 17 A, 19 A, 19 R, 18; 12/142 D, 142 T, 142 RS

(56) References Cited

U.S. PATENT DOCUMENTS 1,522,564 * 1/1925 White ..... 12/142 D
1,922,430 * 8/1933 Game ..... 12/142 D
2,337,121 * 12/1943 Miner ..... 12/142 D
2,958,965 * 11/1960 Scala ..... 36/14
4,182,055 * 1/1980 Turner, Jr. ..... 36/17 R
5,743,027 * 4/1998 Barma ..... 36/14

* cited by examiner

*Primary Examiner*—M. D. Patterson
(74) *Attorney, Agent, or Firm*—Kirschstein, et al.

(57) ABSTRACT

A welted shoe construction and method stitches a molded midsole having an integrally molded welt and a molded midsole flange to an insole mounted within a shoe upper. An outsole having an outsole flange is connected to the midsole by stitching through the outsole flange and the midsole flange, both of which extend completely around the periphery of the upper.

8 Claims, 1 Drawing Sheet

WELTED SHOE CONSTRUCTION AND METHOD

BACKGROUND OF THE INVENTION

1. Field of the Invention

The present investigation generally relates to shoe constructions and, more particularly, to a welted shoe construction and a method of making same.

2. Description of the Related Art

In the construction of a walking shoe, it is known to hand- or machine-stitch a welt, i.e., a strip of leather or other material, between the outsole and the shoe upper, typically to resist the entry of water into the shoe. In one popular welted shoe construction known as the Goodyear welt, an insole is formed with an upstanding wall or rib which is positioned several millimeters inwardly from the outer edge of the insole. During lasting, i.e., the stage in the shoe manufacture where the upper takes its final shape and is fastened to the insole, the upper and any optional linings are secured to this rib. The welt is then sewn to this rib. After the welt has been combined with the shoe upper, an outsole is then stitched to the welt, thereby attaching the outsole to the upper via the welt.

Although generally satisfactory for its intended purpose, the Goodyear welt, as well as other welted shoe constructions, are labor-intensive and costly to manufacture due primarily to the number of handling steps during the lasting process. Simplifying and reducing the cost of manufacture of well-made, water-resistant walking shoes are desirable goals in the field of footwear manufacturing.

SUMMARY OF THE INVENTION

Objects of the Invention

Accordingly, it is a general object of this invention to provide a novel welted shoe construction and method which will simplify and reduce the cost of manufacture of welted shoes.

Another object of this invention is to provide an attractive, durable, welted shoe.

DESCRIPTION OF THE RELATED ART

In keeping with the above objects and others which will become apparent hereafter, one feature of the present invention resides, briefly stated, in a welted shoe construction which includes an upper having a periphery, and an insole mounted within the upper. A molded midsole has a molded welt located exteriorly adjacent, and extending around the periphery of, the upper. The molded midsole has a molded midsole flange of one-piece with, and extending outwardly away from, the molded welt. The midsole flange extends around the periphery of the upper. The molded midsole, the upper and the insole are stitched together in a sub-assembly.

The construction also includes an outsole having an outsole flange underneath the midsole flange and extending around the periphery of the upper. The outsole is stitched to the sub-assembly by stitching the flanges together along the periphery of the upper.

In a preferred embodiment, the upper has edge regions underneath the insole and sandwiched between the insole and the midsole. A plurality of stitches extends through the molded midsole, the edge regions of the upper, and the insole. The molded welt and the midsole flange are preferably molded of a rubber or a synthetic plastic material. The flanges contact each other entirely along the periphery of the upper. A plurality of stitches extends through the flanges in contact with each other to complete the construction.

Another feature resides in a method of making a welted shoe. The method includes mounting an insole within a shoe upper having a periphery; and molding a midsole with a molded welt and a molded midsole flange of one-piece with each other. The midsole flange extends outwardly away from the molded welt. The molded midsole, the upper and the insole are stitched together in a sub-assembly in which the molded welt is located exteriorly adjacent the upper, and in which each of the molded welt and the midsole flange extends around the periphery of the upper.

The method further includes positioning an outsole flange of an outsole underneath the midsole flange. The outsole flange contacts the midsole flange and extends around the periphery of the upper. The outsole is stitched to the sub-assembly by stitching the flanges together along the periphery of the upper.

In the preferred method, the mounting is performed by folding edge regions of the upper underneath the insole and above the midsole. The first stitching step is performed by stitching through the molded midsole, the edge regions of the upper, and the insole. The second stitching step is performed by stitching through the flanges entirely along the periphery of the upper. The molding is performed by molding the welt and the midsole flange of a rubber or a synthetic plastic material.

In accordance with this invention, the welt is not separately attached to any other shoe part, because the welt is of one-piece with the midsole. The insole, upper and midsole are conveniently stitched together in one sewing operation, while the outsole is conveniently stitched to the midsole in another sewing operation. The resulting welted shoe is durable and relatively inexpensive to manufacture due to the limited number of sewing operations.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENT

Figure 1:
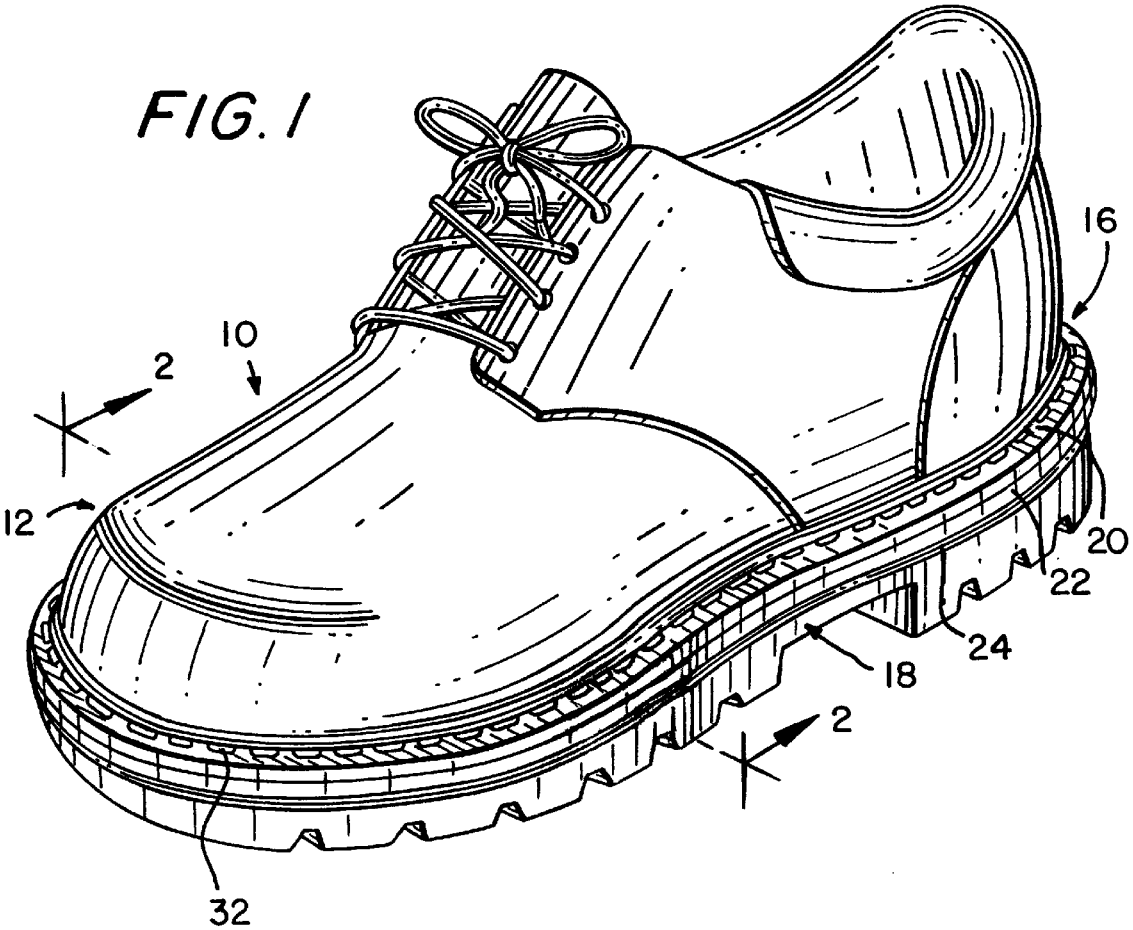
FIG. 1 is a perspective view of a welted shoe constructed in accordance with the method of this invention.

Referring now to the drawing, reference numeral 10 generally identifies a shoe having an upper 12, an insole 14 mounted within the upper 12, a midsole 16, and an outsole 18. The midsole 16 has a welt 20 and a midsole flange 22 of one-piece with the welt 20. The outsole 18 has an outsole flange 24 located underneath the midsole flange 22. Although the invention has been illustrated as a walking shoe, other footwear, such as a boot, could be constructed in accordance with the method of this invention.

Figure 2:
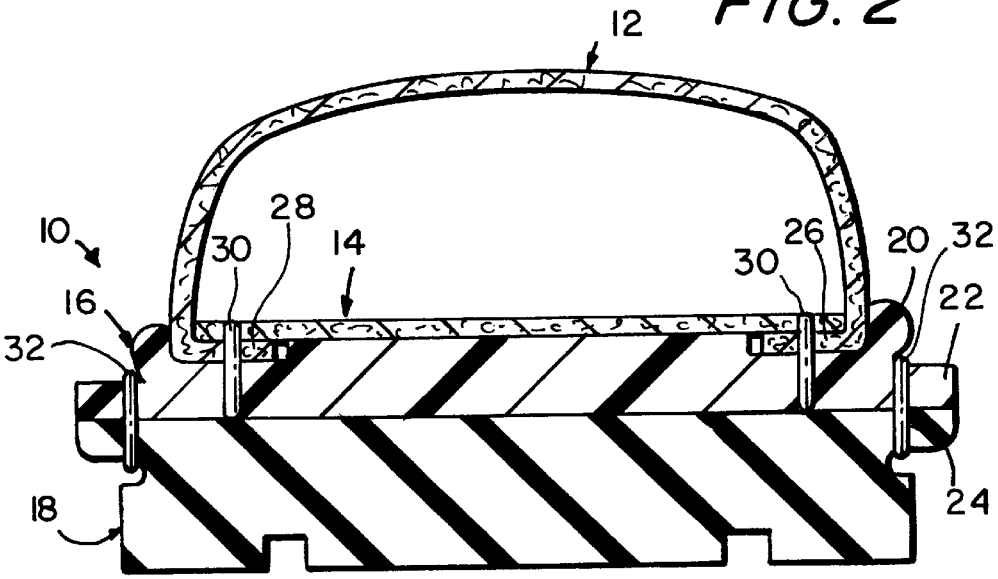
FIG. 2 is an enlarged, sectional view taken on line 2—2 of FIG. 1.

The upper 12 is constituted of a flexible material, typically leather, vinyl, or any other natural or artificial, supple material, that is shaped over a last to impart a curved shape to a front or toe region of the upper, as depicted in FIG. 2.

The outer, lateral, peripheral edge regions 26, 28 of the upper 12 are bent underneath the insole 12 and joined thereto, as explained below.

The insole 14 is constituted of a generally planar, resilient sheet material, such as foam, primarily for cushioning a wearer's foot. Although not illustrated, one or more additional layers or linings may lay over the insole to impart additional cushioning or support for the wearer's foot.

The midsole 16 is molded of a moldable material, such as rubber or a synthetic plastic material, in which the welt 20 and the midsole flange 22 are integral with each other. The welt 20 extends completely around the periphery of the upper, as does the midsole flange 22. The flange 22 extends outwardly away from, and past, the welt 20. The flange 22 generally lies in a horizontal plane.

The upper 12 and the insole 14 located therein are placed on the midsole 16 within the welt 20 so that the welt 20 engages the upper 12 around its entire periphery. Once so assembled, the upper, the insole and the midsole are mechanically joined together, in a sub-assembly by stitching a plurality of stitches 30 through these components. The stitching is typically performed by a machine. Rather than stitches, other joining techniques can be employed. Adhesives, such as glue or shoe cement, are, in any event, typically applied between the edge regions 26, 28 and the lining 14, as well as between the midsole 16 and the edge regions 26, 28, for increased strength.

The sub-assembly is placed on top of the outsole 18 such that the outsole flange 24 directly contacts the midsole flange 22. The outsole flange lies in a generally horizontal plane and extends completely around the periphery of the upper. The outsole 18 is typically constituted of any natural or artificial material, especially one having wear-resistant properties. It is preferred if the outsole 18 is constituted of a rubber or a plastic material, such as polyurethane which has excellent wear properties.

The outsole 18 is mechanically connected to the sub-assembly, by stitching a plurality of stitches 32 through the flanges 22, 24, all along the periphery of the upper. Adhesives, such as glue or shoe cement, are typically applied between the midsole and the outsole for increased strength.

The welt 20 is not only a decorative accessory of the shoe, but also, assists in resisting entry of water into the upper, thus making the welted shoe construction described herein particularly useful in a workboot. The welt 20 is no longer, as in prior art constructions, separately attached to the insole, but is automatically positioned adjacent the upper during joining of the midsole to the upper.

It will be understood that each of the elements described above, or two or more together, also may find a useful application in other types of constructions differing from the types described above.

While the invention has been illustrated and described as embodied in a welted shoe construction and method, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

I claim:

1. A welted shoe construction, comprising:

a) an upper having a periphery;

b) an insole mounted within the upper;

c) a molded midsole having a molded raised welt located exteriorly adjacent, and extending around the periphery of, the upper, the molded midsole having a molded midsole flange of one-piece with, and extending outwardly away from, the molded welt, the midsole flange extending around the periphery of the upper;

d) a first plurality of stitches for stitching the molded midsole, the upper and the insole together in a sub-assembly;

e) an outsole having a height dimension and an outsole flange having a reduced dimension smaller than said height dimension and extending outwardly away from the outsole underneath the midsole flange and extending around the periphery of the upper; and f) a second plurality of stitches exteriorly adjacent the molded welt, for stitching the outsole to the sub-assembly by stitching the flanges together along the periphery of the upper.

2. The shoe construction of claim 1, wherein the upper has edge regions underneath the insole and sandwiched between the insole and the midsole.

3. The shoe construction of claim 2, wherein the first plurality of stitches extends through the molded midsole, the edge regions of the upper, and the insole.

4. The shoe construction of claim 1, wherein the flanges contact each other entirely along the periphery of the upper, and wherein the second plurality of stitches extends though the flanges in contact with each other.

5. A method of making a welted shoe, comprising the steps of:

a) mounting an insole within a shoe upper having a periphery;

b) molding a midsole with a molded raised welt and a molded midsole flange of one-piece with each other, the midsole flange extending outwardly away from the molded welt;

c) stitching the molded midsole, the upper and the insole in a sub-assembly in which the molded welt is located exteriorly adjacent the upper, and in which each of the molded welt and the midsole flange extends around the periphery of the upper;

d) positioning an outsole flange of an outsole having a height dimension underneath the midsole flange, the outsole flange having a reduced dimension smaller than said height dimension and extending outwardly away from the outsole, the outsole flange contacting the midsole flange and extending around the periphery of the upper; and e) stitching the outsole to the sub-assembly by stitching the flanges together exteriorly adjacent the molded welt along the periphery of the upper.

6. The method of claim 5, wherein the mounting step is performed by folding edge regions of the upper underneath the insole and above the midsole.

7. The method of claim 6, wherein the first stitching step is performed by stitching through the molded midsole, the edge regions of the upper, and the insole.

8. The method of claim 5, wherein the second stitching step is performed by stitching through the flanges entirely along the periphery of the upper.

* * * * *